US005626394A

United States Patent [19]

Perry

[11] Patent Number: 5,626,394

[45] Date of Patent: May 6, 1997

[54] TUBULAR CHAIR FRAME

[76] Inventor: Charles O. Perry, 20 Shorehaven Rd., Norwalk, Conn. 06855

[21] Appl. No.: 484,657

[22] Filed: Jun. 7, 1995

[51] Int. Cl.[6] ..... A47C 1/12

[52] U.S. Cl. ..... 297/448.2; 297/239; 297/446.2; 297/452.2; 297/440.24

[58] Field of Search ..... 297/440.24, 440.14, 297/440.1, 440.16, 440.17, 440.18, 440.19, 440.2, 440.21, 440.23, 445, 446, 447, 448, 452.18, 452.19, 452.2, 239, 232, 257, 295, 411.29, 411.27, 411.28, 411.25, 411.23, 411.4, 411.41, 440.15, 230.1, 294, 352, 378.1, 445.1, 446.1, 446.2, 447.1, 447.2, 477.3, 448.1, 448.2, 449.1

[56] References Cited

U.S. PATENT DOCUMENTS

| | | | |
|---|---|---|---|
| D. 102,099 | 11/1936 | Wexelblatt . | |
| 346,454 | 8/1886 | Baldwin | 297/378.1 |
| 1,791,453 | 2/1931 | Mies . | |
| 1,989,426 | 1/1935 | Pollak | 108/91 X |
| 2,345,926 | 4/1944 | Fields et al. | 155/157 |
| 2,419,838 | 4/1947 | James | 297/239 |
| 2,617,471 | 11/1952 | Lorenz | 155/106 |
| 2,874,755 | 2/1959 | Smith | 297/239 X |
| 2,952,300 | 9/1960 | Cohen | 155/2 |
| 2,961,035 | 11/1960 | Lorenz | 155/106 |
| 3,115,368 | 12/1963 | Springer et al. | 297/440.17 X |
| 3,246,927 | 4/1966 | Klassen | 297/239 |
| 3,266,843 | 8/1966 | Feder | 297/411.28 X |
| 3,316,016 | 4/1967 | Petersen | 297/239 |
| 3,334,942 | 8/1967 | Breslow | 108/91 X |
| 3,815,955 | 6/1974 | Gibiherra | 297/295 |
| 3,817,573 | 6/1974 | Facury | 108/91 X |
| 3,822,079 | 7/1974 | Probber | 297/440.24 X |
| 3,847,433 | 11/1974 | Acton et al. | 297/411.4 X |
| 3,999,802 | 12/1976 | Powers | 297/447 |
| 4,522,444 | 6/1985 | Pollock | 297/239 |
| 4,548,441 | 10/1985 | Ogg | 297/239 |
| 4,648,653 | 3/1987 | Rowland | 297/239 |
| 4,787,319 | 11/1988 | Dupraz | 108/91 X |
| 5,131,715 | 7/1992 | Balles | 297/118 X |
| 5,180,208 | 1/1993 | Lawandi | 297/440.24 X |

FOREIGN PATENT DOCUMENTS

| | | | |
|---|---|---|---|
| 632397 | 12/1961 | Canada | 297/239 |
| 1249503 | 1/1989 | Canada | 155/52 |
| 610741 | 10/1948 | United Kingdom . | |
| 754209 | 8/1956 | United Kingdom | 297/239 |

OTHER PUBLICATIONS

Copy of marketing brochure by Krueger International entitled "Perry Seating" dated 1992.

*Primary Examiner*—Milton Nelson, Jr.
*Attorney, Agent, or Firm*—Limbach & Limbach, LLP

[57] ABSTRACT

A flexible chair frame includes symmetrical sides having at least a first crossbar affixed between the rear portions of the sides at seat level. The seat bottom portion of each side is angled upwardly near its end and includes a stacking insert with a tab extending therefrom and a second crossbar coupled between respective stacking inserts. A third crossbar is coupled between the rear portions and may include an arm portion. The chairs may be stacked such that the first crossbar of one chair rests on the stacking inserts of the chair below, regardless of whether arm portions are included on the third crossbar.

10 Claims, 4 Drawing Sheets

TUBULAR CHAIR FRAME

BACKROUND OF THE INVENTION

This invention relates to a flexible chair which is capable of high density stacking for storage and transport. The use of low-cost, stacking chairs is well-known. Such chairs are usually not designed for comfort or ergonomics, but instead, are designed simply to provide a large quantity of temporary seats for occasional use which can be efficiently stored and take up minimal storage space. Typically, a dolly is used to hold and transport the chairs which are stacked as densely as possible. Such chairs may have some limited flexibility, but typically provide no ergonomic benefits.

I have previously disclosed a high density stacking chair in my U.S. Pat. No. 5,383,712. This chair provides exceptional comfort with high stacking density by using a flexible frame which flexes to permit partial reclining of the chair back while at the same time applying lumbar pressure to the user's low back. One version of this chair is commercially available as the Perry Chair, manufactured by the Krueger International Company of Green Bay, Wis.

SUMMARY OF THE INVENTION

A flexible chair frame is constructed from resilient tubular material and includes symmetrical sides having at least a first crossbar affixed between the rear portions of the sides at seat level. The seat bottom portion of each side is angled upwardly near its end and includes a stacking insert with a tab extending therefrom and a second crossbar coupled between respective stacking inserts. A third crossbar is coupled between the rear portions. The third crossbar may include an arm portion.

The chairs may be stacked such that the first crossbar of one chair rests on the stacking inserts of the chair below, regardless of whether arm portions are included on the third crossbar.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE INVENTION

Figure 1:
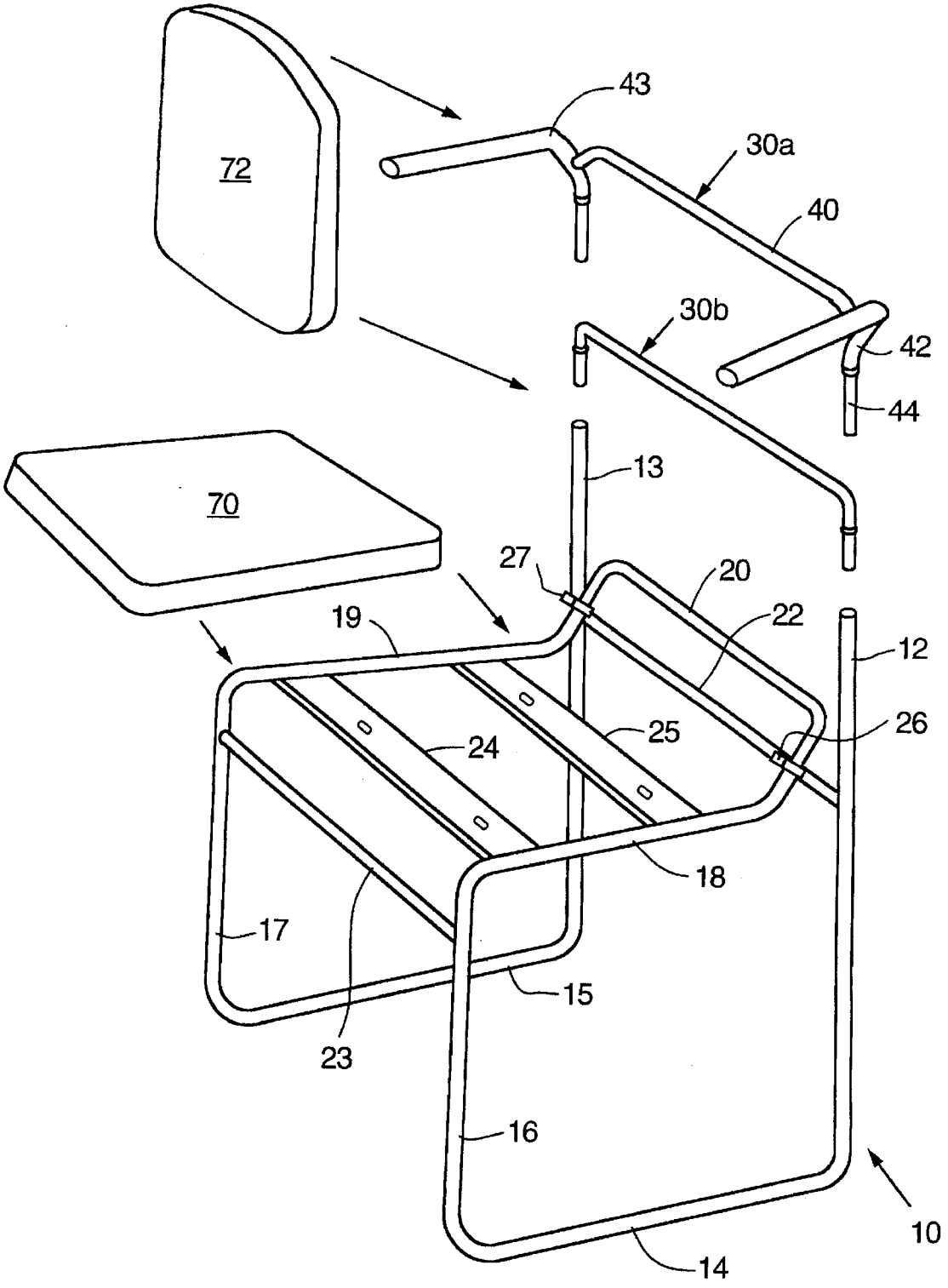
FIG. 1 is a perspective view of a tubular chair frame.

Referring now to FIG. 1, the basic frame 10 for my chair is a symmetrical structure of hollow steel rod including rear portions 12 and 13, floor portions 14 and 15, front portions 16 and 17, seat portions 18 and 19, and crossbar 20. A second crossbar 22 is affixed between rear portions 12 and 13, and a third crossbar 23 is affixed between front portions 16 and 17, for example by weldment. A pair of straps 24 and 25 are affixed between seat portions 18 and 19 by weldment for supporting and attaching the seat bottom (70). A pair of stacking registers 26 and 27 are coupled between the crossbar 20 and the seat portions 18 and 19, respectively.

There are two completely interchangeable crossbar portions 30*a* and 30*b*, either one of which will couple to the rear portions 12 and 13. The crossbar portion 30*a* is used for chairs where an arm is desired, and the crossbar portion 30*b* is used for chairs where no arm is desired.

The frame 10 is preferably constructed from ¾ inch diameter stainless steel tubing, except for the straps 24 and 25, which are flat stock steel, and the stacking registers 26 and 27.

Each side of the frame 10, namely rear portion 12, floor portion 14, front portion 16, and seat portion 18 forming one side and rear portion 13, floor portion 15, front portion 17, and seat portion 19 forming the other side, is preferably a single continuous piece of tubing, but may also be segmented and butt welded or otherwise connected, as is fully disclosed in my prior U.S. Pat. No. 5,383,712, which is expressly incorporated herein by reference.

Figure 2:
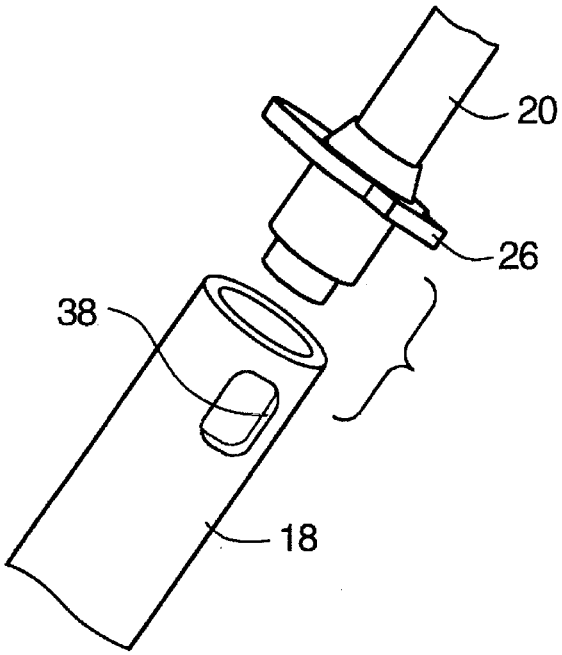
FIG. 2 a detailed illustration of a portion of the chair of FIG. 1.
Figure 3:
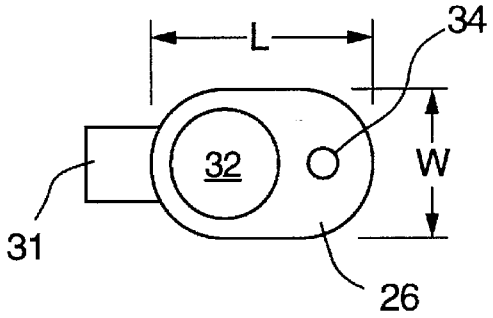
FIG. 3 illustrates the crossbar insert portion of the chair of FIG. 1.
Figure 4A:
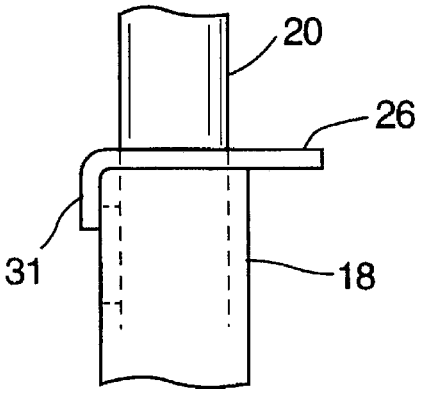
FIGS. 4*a*, 4*b* and 4*c* illustrate the connection of the crossbar and insert to the chair frame.
Figure 4C:
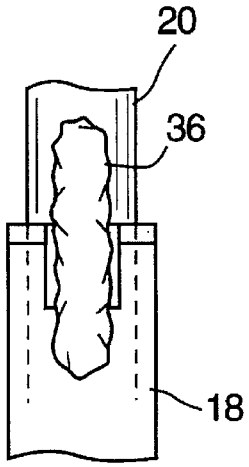
Figure 4B:
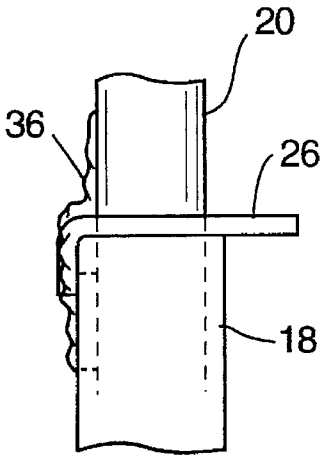

Referring now to FIGS. 2 through 4, the coupling between the crossbar 20 and seat portions 18 and 19 is illustrated in more detail. The stacking registers 26 and 27 are inserts which receive the crossbar 20 into one end and then plug into the seat portions 18 and 19, respectively, where they and the crossbar may be further secured by weldment, for example.

Each insert is an oval-shaped piece of metal or plastic measuring approximately 1 and ⅛ inches in length L by ¾ inches in width W with a thickness of 3/32 inches, with an additional tab 31 extending from one side of the insert. A first opening 32 measuring approximately ⅝ inches in diameter is provided for inserting the crossbar 20 therethrough. The crossbar 20 is narrowed at this point to have a ⅝ inch outside diameter and a ½ inch inside diameter at its ends to facilitate coupling. A second opening 34 is advantageously provided to permit a standard snap to be employed with a snap-on seat cushion.

The tab 31 is bent over at a right angle, as shown in FIG. 4*a*, then the inserts 26 and 27 are positioned relative to seat portions 18 and 19, respectively and crossbar 20 is inserted into the seat portions through the inserts. A plug weld 36 may then be made through the slot 38 in seat portion 18 to secure both the insert 26 and the crossbar 20 to the seat portion.

Figure 5:
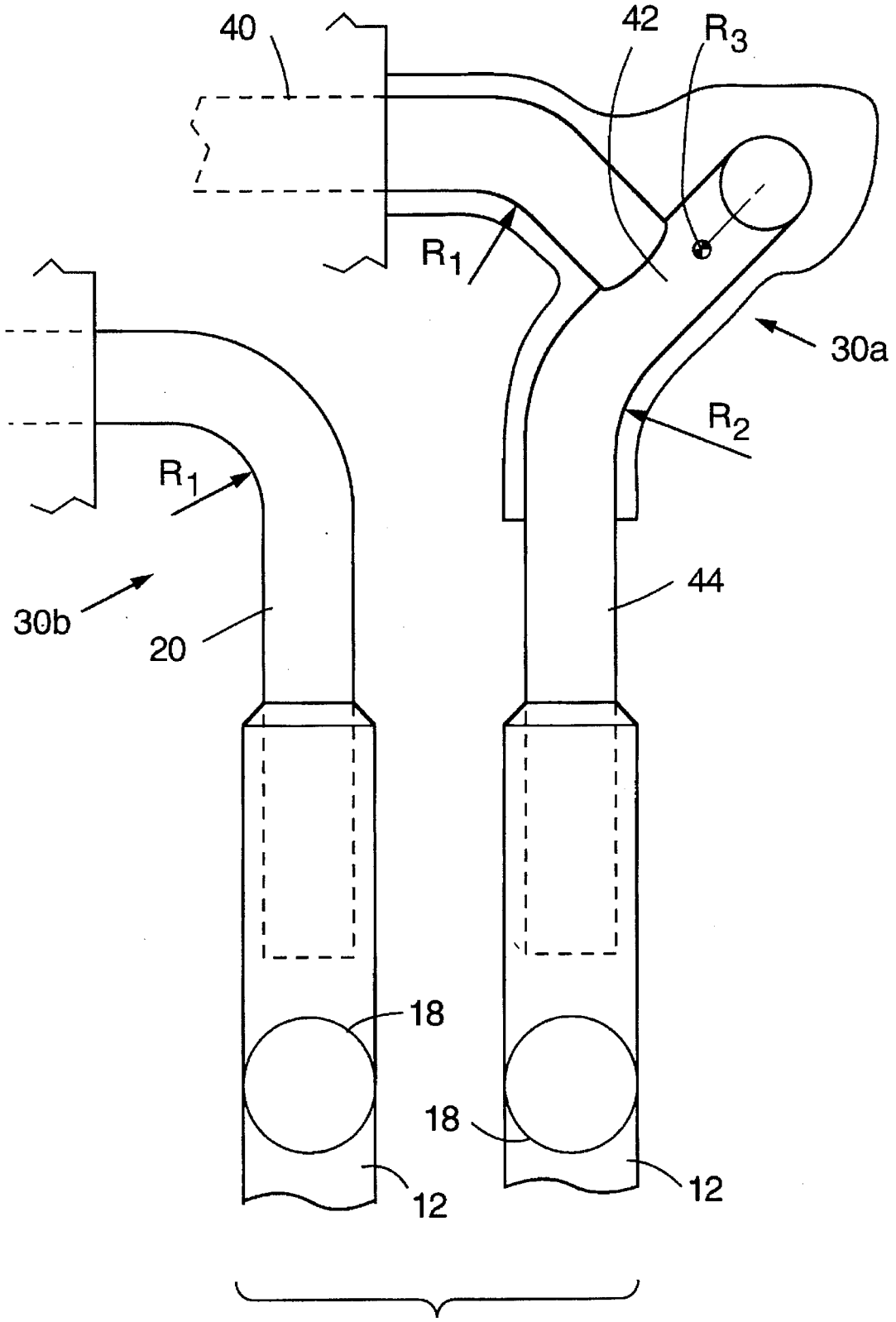
FIG. 5 is a detailed illustration of the arm crossbar portion of the chair of FIG. 1.

A detailed illustration of the arm chair crossbar 30a is shown in FIG. 5. The crossbar 30*a*includes a rear section 40 which has a ½ inch radius turn $R_1$ at each end thereof, each end being welded to an arm section 42 (arm section 43 is shown in FIG. 1). The arm section 42 is coupled to the rear portion 12, preferably by a short insert piece 44, which may be butt welded at either end. The arm section 42 angles upward and outward from the side of the chair at a ¾ inch radius $R_2$, then turns forward at a 90 degree radius $R_3$. The arm section 42 is preferably covered with plastic or neoprene foam for comfort.

The non-arm crossbar 30*b* is shown in FIG. 1, and is a single piece of tubing having 90 degree turns at each end which insert into the rear portions 12 and 13, respectively, of the frame 10.

A seat back (72) preferably encloses crossbar 20 and crossbar 30*a* or 30*b* to provide pivoting action in the manner disclosed in my prior U.S. Pat. No. 5,383,712, although other attachment methods may also be used.

Figure 6:
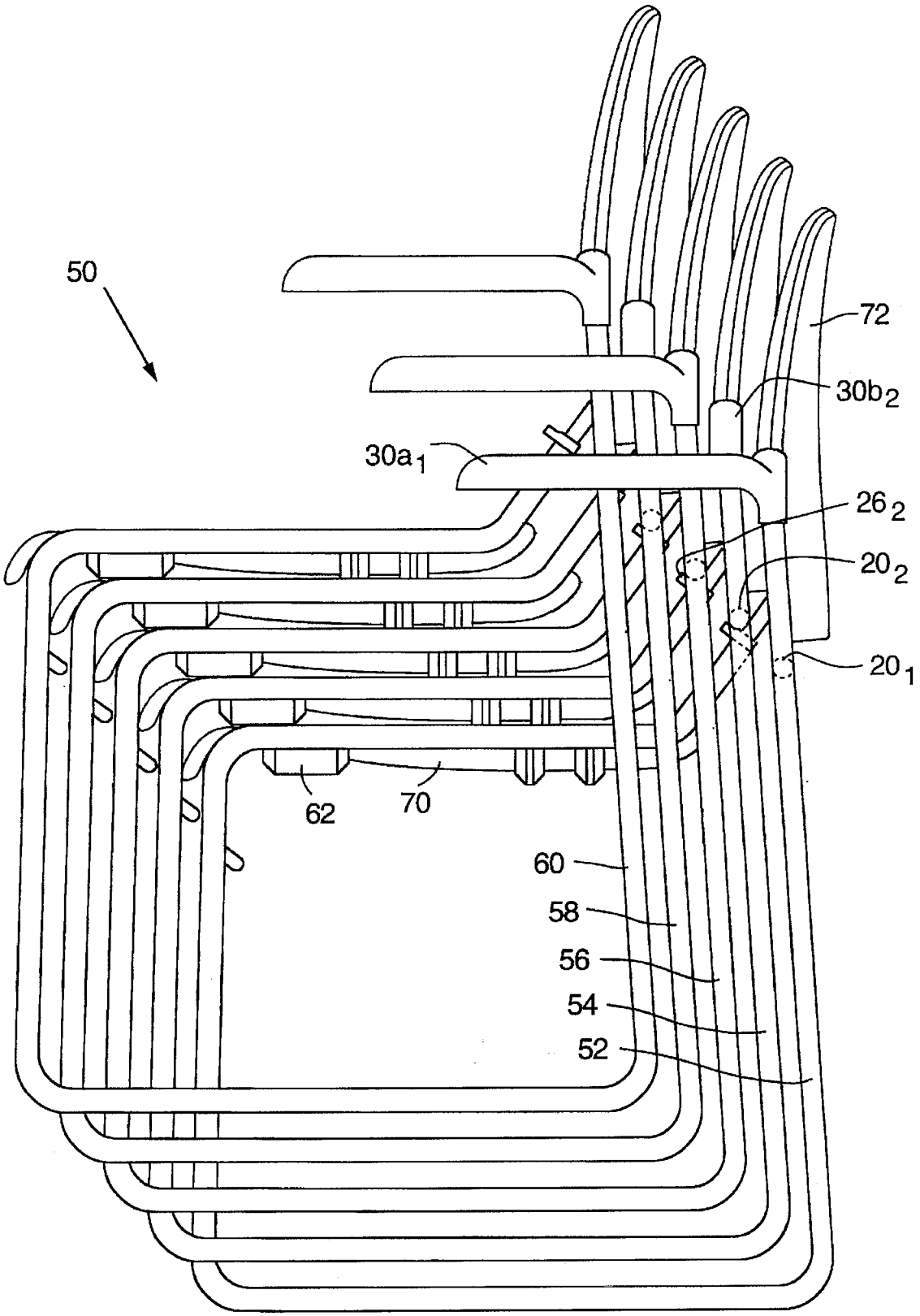
FIG. 6 is a plan view of a stack of chairs.

A stack 50 of chairs constructed according to the present invention is shown in FIG. 6. The bottom chair 52, middle chair 56, and top chair 60 include arm crossbars $30a_1$, $30a_3$, and $30a_5$, respectively, while the intermediate chairs 54 and 58 include non-arm crossbars $30b_2$ and $30b_4$, respectively. The chairs are able to stack interchangeably without regard to arms or lack thereof. The crossbar 20 of each chair rests on the stacking registers 26 and 27 of the chair below. Advantageously, a bumper 62 may be provided under the front of the seat bottom to give additional stability to the stack.

It should be understood that the invention is not intended to be limited by the specifics of the above-described embodiment, but rather defined by the accompanying claims.

I claim:

1. A chair frame, comprising:

a pair of support legs one at each side, each support leg comprising a contiguous arrangement beginning with a resilient back leg portion oriented substantially vertically, then to a bottom leg portion extending horizontally along a floor surface, then to a front leg portion extending upwardly from the bottom leg portion, and then to a seat bottom portion extending rearwardly then turning upwardly at an acute angle to an end thereof;

a first crossbar coupled between the ends of the seat bottom portions;

a pair of stacking inserts coupled proximate to the ends of the seat bottom portions, each stacking insert having a tab extending forwardly therefrom;

a second crossbar coupled between the back leg portions at a location which is below but proximate to the stacking inserts; and a third crossbar coupled between the ends of the back leg portions.

2. A chair frame as in claim 1, wherein the third crossbar includes arms extending forwardly therefrom on each side.

3. A high density stack of chairs, comprising a plurality of first chairs stacked in random order with a plurality of second chairs in nested overlapping relation, wherein each first chair and each second chair are substantially identical except that each first chair is an armchair and each second chair is a non-arm chair, and wherein the distance between adjacent chairs in the stack is substantially the same.

4. A high density stack of chairs as in claim 3, wherein each first chair comprises:

a first pair of support legs one at each side, each support leg comprising a contiguous arrangement beginning with a resilient back leg portion oriented substantially vertically, then to a bottom leg portion extending horizontally, then to a front leg portion extending upwardly from the bottom leg portion, and then to a seat bottom portion extending rearwardly then turning upwardly at an acute angle to an end thereof;

a first crossbar coupled between the ends of the first seat bottom portions;

a first pair of stacking inserts coupled proximate to the ends of the first seat bottom portions, each first stacking insert having a tab extending forwardly therefrom;

a second crossbar coupled between the first back leg portions at a location which is below but proximate to the first pair of stacking inserts and which will rest on tabs extending from stacking inserts on another chair positioned immediately below the first chair; and a third crossbar coupled between the ends of the first back leg portions, said third crossbar including arms extending forwardly therefrom on each side;

and wherein each second chair comprises:

a second pair of support legs one at each side, each support leg comprising a contiguous arrangement beginning with a resilient back leg portion oriented substantially vertically, then to a bottom leg portion extending horizontally, then to a front leg portion extending upwardly from the bottom leg portion, and then to a seat bottom portion extending rearwardly then turning upwardly at an acute angle to an end thereof;

a fourth crossbar coupled between the ends of the second seat bottom portions;

a second pair of stacking inserts coupled proximate to the ends of the second pair of seat bottom portions, each second stacking insert having a tab extending forwardly therefrom;

a fifth crossbar coupled between the second back leg portions at a location which is below but proximate to the second stacking inserts and which will rest on tabs extending from stacking inserts on another chair positioned immediately below the second chair; and a sixth crossbar coupled between the ends of the second back leg portions.

5. A high density stack of chairs as in claim 3, each chair comprising a frame having symmetrically disposed side frame members, each side frame member having a back leg portion oriented substantially vertical and contiguous with a bottom leg portion oriented substantially horizontal and contiguous with a front leg portion oriented substantially vertical and contiguous with a seat bottom portion oriented substantially horizontal, a seat having a front and a rear and coupled to the seat bottom portions of the frame such that the seat bottom portions extend beyond the rear of the seat, a back having an upper back portion coupled to the back leg portions of the frame and a lower back portion coupled to the seat bottom portions of the frame which extend beyond the rear of the seat, and a pair of stacking tabs extending forwardly from the frame just above the rear of the seat.

6. A high density stack of chairs as in claim 5, wherein the frame further comprises a first crossbar coupled between the seat bottom portions which extend beyond the rear of the seat, wherein the lower back portion of the back is coupled to the first crossbar and wherein the stacking tabs are positioned proximate to the first crossbar and oriented to receive by contact a similar crossbar on a similar chair stacked above.

7. A high density stack of chairs as in claim 5, further comprising a pair of arms extending forwardly from either side of the frame.

8. A chair, comprising:

a frame having symmetrically disposed side frame members, each side frame member having a back leg portion oriented substantially vertical and contiguous with a bottom leg portion oriented substantially horizontal and contiguous with a front leg portion oriented substantially vertical and contiguous with a seat bottom portion oriented substantially horizontal, a seat having a front and a rear and coupled to the seat bottom portions of the frame such that the seat bottoms portions extend beyond the rear of the seat, a back having an upper back portion coupled to the back leg portions of the frame and a lower back portion coupled to the seat bottom portions of the frame which extend beyond the rear of the seat, and a pair of stacking tabs extending forwardly from the frame just above the rear of the seat.

9. A chair as in claim 8, further comprising a first crossbar coupled between the seat bottom portions which extend beyond the rear of the seat, and wherein the stacking tabs are positioned to contact the first crossbar on a similar chair stacked on top of the chair.

10. A chair as in claim 8, further comprising a second crossbar coupled to the back leg portion and having arms extending forwardly on either side of the frame.

* * * * *